US005161790A

United States Patent [19]

March

[11] Patent Number: 5,161,790

[45] Date of Patent: Nov. 10, 1992

[54] DEVICE FOR OPENING BINDERY LINE SIGNATURES

[75] Inventor: Harry V. March, Beavercreek, Ohio

[73] Assignee: Eastman Kodak Company, Rochester, N.Y.

[21] Appl. No.: 770,220

[22] Filed: Oct. 3, 1991

[51] Int. Cl.[5] ..... B41F 13/54

[52] U.S. Cl. ..... 270/1.1; 270/54

[58] Field of Search ..... 270/1.1, 53, 54, 55, 270/51, 58

[56] References Cited

U.S. PATENT DOCUMENTS

| | | | |
|---|---|---|---|
| 4,149,711 | 4/1979 | Jackson | 270/57 |
| 4,395,031 | 7/1983 | Gruber et al. | 270/54 |
| 4,401,300 | 8/1983 | Morin | 270/55 |
| 4,486,011 | 12/1984 | Rhunke | 270/57 |

FOREIGN PATENT DOCUMENTS

| | | | |
|---|---|---|---|
| 1218401 | 6/1966 | Fed. Rep. of Germany | 270/54 |
| 2749095 | 5/1979 | Fed. Rep. of Germany | 270/55 |
| 1949769 | 8/1979 | Fed. Rep. of Germany | 270/55 |

*Primary Examiner*—Edward K. Look
*Assistant Examiner*—Therese M. Newholm
*Attorney, Agent, or Firm*—Thomas H. Close

[57] ABSTRACT

An improved plow construction for a signature printing system wherein a collating conveyor chain moves past a plurality of signature feeder stations which cooperatively build-up books on said chain and wherein a signature lifting plow device and a signature printer cooperate to effect printing on an inside page of signature. The improved plow device is constructed with a configured-sheet deflection element having: (i) a lead edge region located at an upstream position and extending generally radially below said conveyor chain; (ii) a trail end region located at a downstream position and extending generally radially from said conveyor chain, above said lead edge region and (iii) an intermediate section having a curved surface joining said lead and trail edge regions.

6 Claims, 3 Drawing Sheets

DEVICE FOR OPENING BINDERY LINE SIGNATURES

FIELD OF THE INVENTION

The present invention relates to bindery line systems of the kind wherein a plurality of folded sections (signatures) are combined to form "books" (as used herein meaning magazines, advertising brochures, etc), and more specifically, the invention relates to structural and functional improvements for opening such books on the bindery line to print personalized data on selected ones of the signature pages.

BACKGROUND OF INVENTION

Recently, there has been interest in personalized printing on (or inside) bindery line "books", as the folded sections (signatures) are gathered on the bindery equipment. Ink jet printing is a currently preferred way to accomplish such on-line personalizing; and U.S. Pat. No. 4,395,031 describes a very useful system for enabling ink jet printing on the books which are assembled, but still on the bindery system conveyor chain. This system uses a device referred to as a "plow", which causes the book to open in a manner allowing print head access to an interior page(s).

The plow device described in the '031 patent is a generally rectangular, planar member located along the bindery line, generally within a plane that extends radially from a line defined by the path of the conveyor chain. The upstream end of the planar member is tapered in toward the conveyor chain to form a plow tip portion which impacts the interior lead edges of signatures that are above a plow wire, which extends upstream from the plow tip. The plow surface deflects the engaged signatures outwardly and upwardly as they move past it, in the downstream direction. Ink jet print heads are located beneath the plate-like plow member to print on the exposed signature page.

While the plow device described in the '031 patent functions reasonably well, there is a real problem as to signatures flapping open too far, or falling off the bindery chain. This problem worsens as bindery speeds increase. The system in the '031 patent provides rollers to bias the spines of signatures against the chain, thereby preventing signatures from lifting off the chain; however, it would be desirable to avoid the need for such bias rollers. Also, the rollers cannot prevent the non-constrained portions of the signature from flapping up and down into contact with print heads, which carry ink debris that would mar the signature. Further, signatures flapping into contact with other parts of the apparatus can cause major paper jams.

SUMMARY OF INVENTION

Thus, one significant purpose of the present invention is to provide an improved plow construction that reduces the forces tending to move the signature sheet away from the plow surface. One advantage of the present invention is to enable operation with higher bindery chain velocities without causing the signatures to leave the bindery chain or to flap into contact with the printing device or other parts of the bindery system.

In one aspect the present invention constitutes an improved plow construction for use in a signature printing system wherein a collating conveyor chain moves past a plurality of signature feeder stations which cooperatively build-up books on the chain and wherein a signature-lifting plow device and a signature printer cooperate to effect printing on an inside page of signature books. The improved plow device comprises a configured-sheet deflection element having: (i) a lead end region located at an upstream position and extending generally radially below the conveyor chain; (ii) a trail end region located at a downstream position and extending generally radially from the conveyor chain, above the lead edge region and (iii) an intermediate section having a convolute surface joining the lead and trail end regions.

BRIEF DESCRIPTION OF DRAWINGS

The subsequent description of preferred embodiments refers to the accompanying drawings wherein.

DETAILED DESCRIPTION OF PREFERRED EMBODIMENTS

Figure 1:
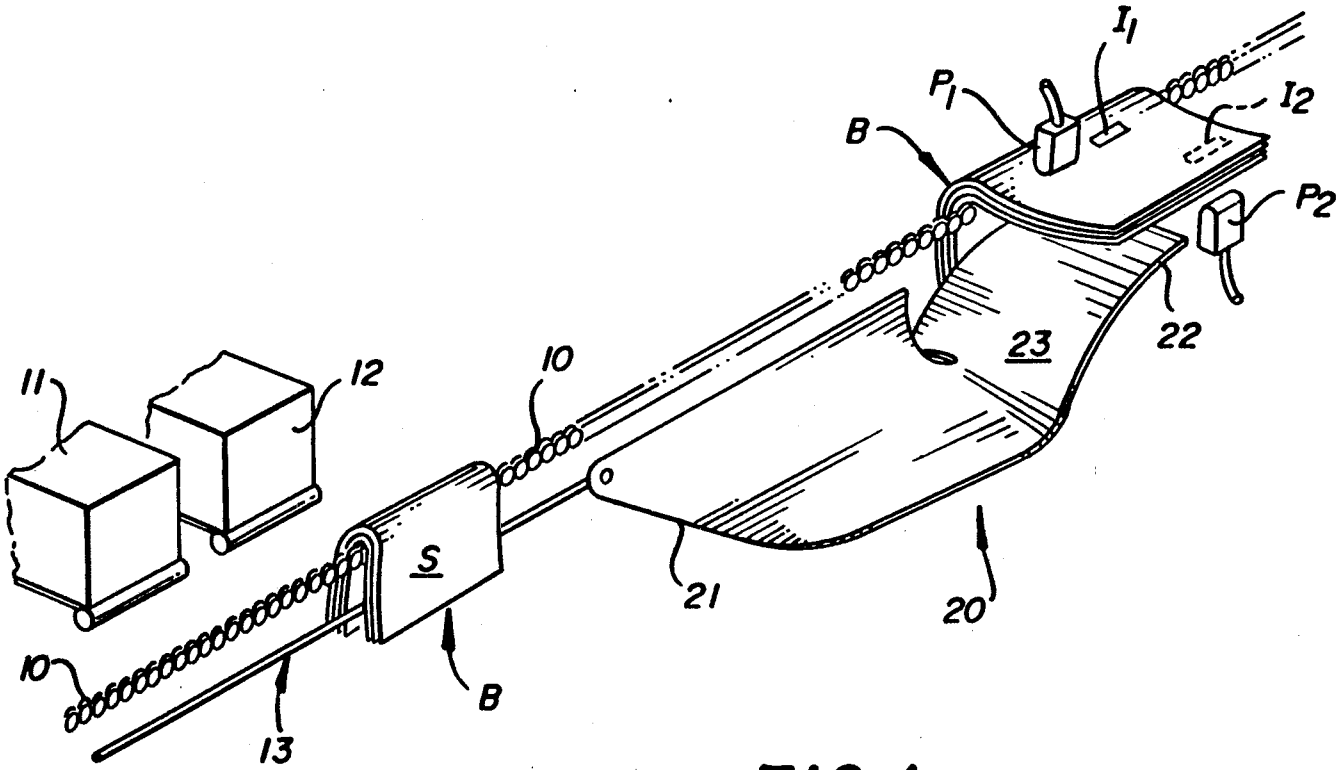
FIG. 1 is a schematic perspective view showing an exemplary signature collation system incorporating one preferred embodiment of the present invention.
Figure 2:
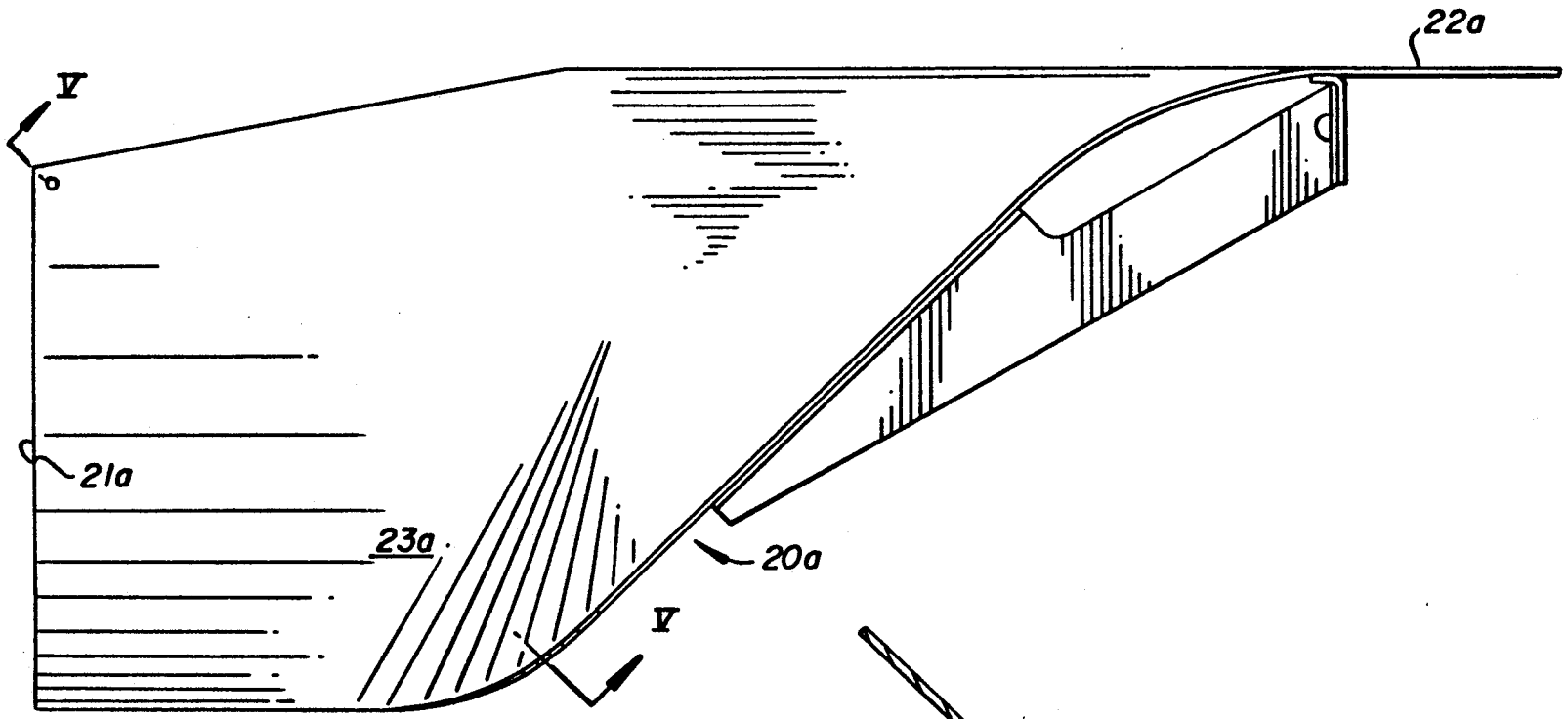
FIG. 2 is a side elevation of an alternative preferred signature deflection element.
Figure 5:
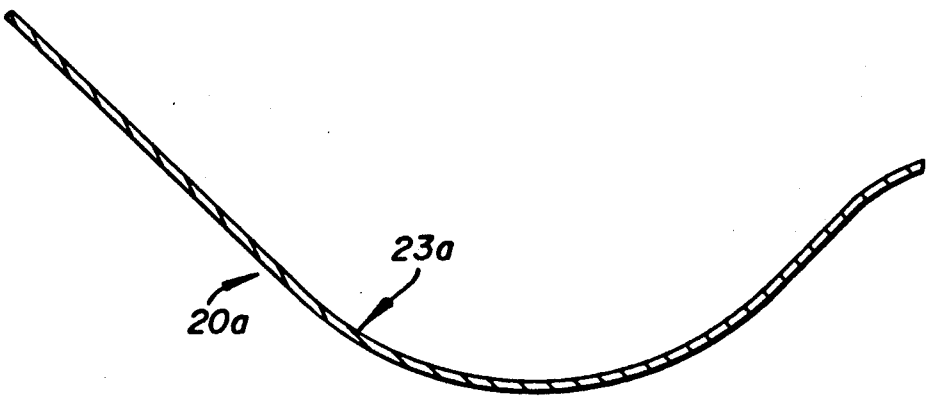
FIG. 5 is a cross-section along the line V—V in FIG. 2.
Figure 3:
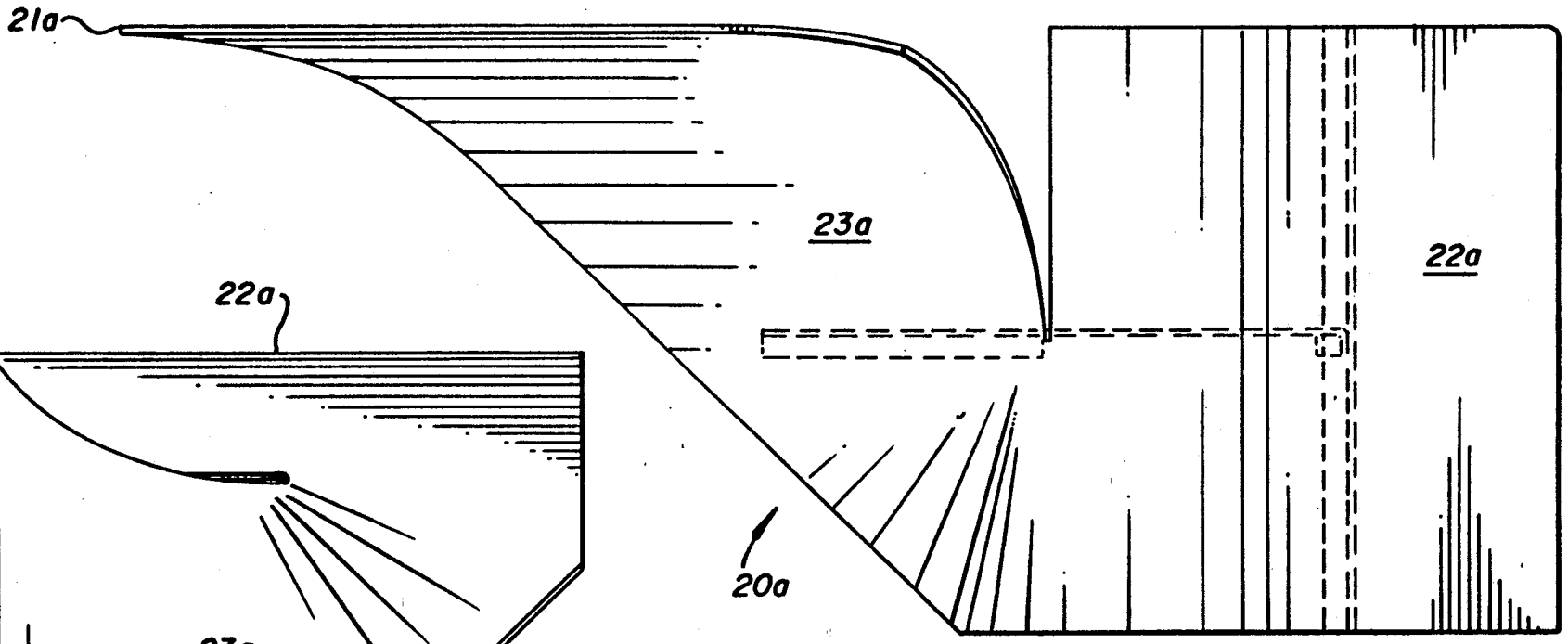
FIG. 3 is a top view of the FIG. 2 element.
Figure 4:
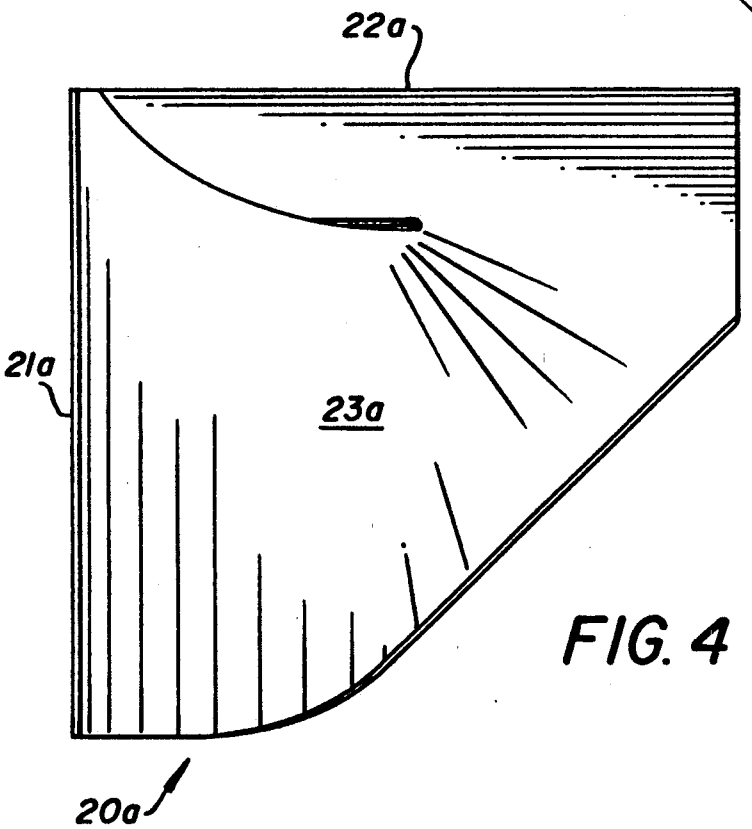
FIG. 4 is a side view of the FIG. 2 element.

The present invention is advantageously employed in a collating system such as shown in FIG. 1 wherein a signature conveyor chain 10 is moved past successive feeder boxes 11, 12. Signatures S are fed from the feeder boxes to build-up books B that travel along the path of the chain to eventually reach a finishing station (not shown) where functions such as trimming, stitching, etc. are performed. As shown in FIG. 1, a separator wire or cord 13 extends adjacent the conveyor chain 10 from a location upstream of feeder boxes 11, 12 so that previously fed signature(s) are on the chain side of the cord 13 and signatures from feeder boxes 11, 12 are on the opposite side of the cord 13. The downstream end of cord 13 is connected to one embodiment of plow device in accord with the present invention. Thus, plow device 20 is constructed and located to deflect signatures S to an open condition so the print heads (e.g. as schematically indicated by $P_1$ and/or $P_2$) can print information $I_1$, $I_2$ on pages of the opened book.

The print heads $P_1$, $P_2$ can be selected from various known structures, e.g. such as described in U.S. Pat. No. 4,928,115. Similarly, the other detail structures of the collation system can be selected from known prior art devices such as described e.g. in U.S. Pat. No. 4,395,031. The teachings important to practice of the present invention pertain to the improved constructions of the plow devices such as shown in FIG. 1. Thus, it can be seen that the plow deflection element 20 comprises a configured sheet construction, e.g. fabricated sheet metal, that has been formed and mounted along the bindery line to have: (i) a lead end region 21 that is located at an upstream position and extends generally radially-vertical below chain 10; (ii) a trail end region 22 constructed relative to the other element portions to be located at a downstream position and extend generally radially-horizontal adjacent the conveyor chain 10; and (iii) an intermediate section 23 between regions 21 and 22 which joins those lead and trail end regions with a smooth curve surface.

One highly preferred configuration for the intermediate section is the form of a cycloidal cam surface that extends from the vertical lead edge region 21 to the horizontal trail edge region 22. As described in *The Standard Handbook for Mechanical Engineers*, 7th Edition Baumeister and Marks McGraw Hill, 1967, the cycloidal cam shape is a curved surface that minimizes acceleration of its follower. Therefore a signature deflected by cycloidal surface 23 will move from region 21 to region 22 with minimal acceleration and arrive at region 22 with very low vertical velocity, e.g. theoretically zero velocity. The following table shows vertical displacements, velocity and acceleration for one preferred embodiment of cycloidal cam surface plow configuration wherein the signature travelling 300 fpm is elevated a distance (y) of 12 inches from vertical to horizontal over a distance (x) along the conveyor of 24 inches.

FIGS. 2-5 show another preferred embodiment of plow device 20*a*, wherein the curved surface 23*a* of the device has been simplified to a convolute surface formed by bending and comprising circular cylindrical surfaces and planes. The simplified device of FIGS. 2-5 has been found to operate successfully with conveyor chain speeds of 300 fpm. Other curved configurations which minimize the acceleration of the signatures during opening movement will occur to those skilled in the art.

The invention has been described in detail with particular reference to certain preferred embodiments thereof, but it will be understood that variations and modifications can be effected within the spirit and scope of the invention.

I claim:

1. In a signature printing system wherein a collating conveyor chain moves past a plurality of signature feeder stations which cooperatively build-up books on said chain and wherein a signature lifting plow device and a signature printer cooperate to effect printing on an inside page(s) of book, an improved plow device construction comprising a configured-sheet deflection element having: (i) a lead edge region located at an upstream position and extending generally radially-vertical below said conveyor chain; (ii) a trail end region located at a downstream position and extending generally radially-horizontal adjacent said conveyor chain and (iii) an intermediate section having a curved surface joining said lead and trail edge regions.

2. The invention defined in claim 1 wherein said intermediate section of said deflection element is configured to approximate a cycloid cam surface.

3. The invention defined in claim 1 wherein said intermediate section of said deflection element is convolute, comprising a circular cylindrical surface.

4. In a signature printing system wherein a collating conveyor chain moves past a plurality of signature feeder stations which cooperatively build-up books on said chain and wherein a signature lifting plow device and a signature printer cooperate to effect printing on an inside page of signature, an improved plow device construction comprising a configured-sheet deflection element having: (i) a lead edge region located at an upstream position and extending generally radially below said conveyor chain; (ii) a trail end region located at a downstream position and extending generally radially from said conveyor chain, above said lead edge region and (iii) an intermediate section having a curved surface joining said lead and trail edge regions.

5. The invention defined in claim 4 wherein said intermediate section of said deflection element is configured to approximate a cycloid cam surface.

6. The invention defined in claim 4 wherein said intermediate section of said deflection element comprises circular cylindrical surfaces.

* * * * *